US008005405B2

(12) United States Patent
Hatakeyama et al.

(10) Patent No.: US 8,005,405 B2
(45) Date of Patent: Aug. 23, 2011

(54) DEVELOPING UNIT AND DEVELOPER STIRRING AND TRANSPORTING METHOD

(75) Inventors: Takashi Hatakeyama, Kanagawa-ken (JP); Hiroshi Murata, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/836,835

(22) Filed: Jul. 15, 2010

(65) Prior Publication Data

US 2010/0278563 A1 Nov. 4, 2010

Related U.S. Application Data

(63) Continuation of application No. 11/456,995, filed on Jul. 12, 2006, now Pat. No. 7,783,228.

(51) Int. Cl.
*G03G 15/08* (2006.01)

(52) U.S. Cl. ..... 399/254

(58) Field of Classification Search ..... 399/119, 399/260

See application file for complete search history.

(56) References Cited

U.S. PATENT DOCUMENTS

| | | | |
|---|---|---|---|
| 5,572,300 | A | 11/1996 | Yamasa et al. |
| 6,421,516 | B1 | 7/2002 | Kinoshita et al. |
| 2006/0062599 | A1 | 3/2006 | Shimmura et al. |
| 2006/0165440 | A1 | 7/2006 | Adachi |

FOREIGN PATENT DOCUMENTS

| | | |
|---|---|---|
| JP | 07-121021 | 5/1995 |
| JP | 2000-81787 | 3/2000 |
| JP | 2004-145115 | 5/2004 |

OTHER PUBLICATIONS

Office Action for U.S. Appl. No. 11/456,995 mailed on Jul. 22, 2009.
Office Action for U.S. Appl. No. 11/456,995 mailed on Jan. 7, 2010.

*Primary Examiner* — David M Gray
*Assistant Examiner* — Andrew V Do
(74) *Attorney, Agent, or Firm* — Turocy & Watson, LLP

(57) ABSTRACT

A developing unit and a developer stirring and transporting method are provided that enable smooth discharge of a developer in the developing unit without being affected by the inclination of the developing unit. A developing unit 10 has a developing roller 12, a housing unit 16 configured to house a developer and having in its sidewall a discharge port 14 which discharges overflowing developer, a stirring and transporting member 20 configured to stir and transport the developer along a passage 18 formed in the housing unit 16, and a deposit structure unit 22 provided in the passage 18 and configured to raise the height position of a bottom surface 18*a* part of the passage 18 corresponding at least to the discharge port 14 to a position higher than the other areas of the passage 18, and thereby deposit the developer near the discharge port 14.

16 Claims, 10 Drawing Sheets

DEVELOPING UNIT AND DEVELOPER STIRRING AND TRANSPORTING METHOD

CROSS-REFERENCE TO RELATED APPLICATIONS

This application is a Continuation of application Ser. No. 11/456,995 filed on Jul. 12, 2006, the entire contents of which are incorporated herein by reference.

BACKGROUND OF THE INVENTION

1. Field of the Invention

This invention relates to a developing unit and a developer stirring and transporting method.

2. Description of the Related Art

Conventionally, in discharging a developer in a developing unit from the developing unit, the developer is discharged by overflow from a developer discharge port formed in a sidewall of the developing unit. In this structure, in order to cause overflow more easily, a technique is known in which a rotary blade near the developer discharge port of a second transport member that stirs and transports the developer is replaced by a rotary blade having less transporting power than an ordinary one, thereby locally raising the height of the top surface of the developer near the developer discharge port to a position higher than the other areas (see, for example, JP-A-2000-81787).

In such a developing system, a carrier is supplied together with toner into the developing unit by a small amount each, and excessive developer is caused to overflow from the developer discharge port, thus constantly replacing degraded developer. Therefore, development performance can be maintained and deterioration in image quality can be restrained. Since batched replacement of the developer is not carried out, good maintenance property can be kept. Also, since a small quantity of developer suffices, the developing unit can be miniaturized and the machine can be miniaturized. However, as the machine is miniaturized, it can be put in various places such as on the floor or desk, and it is less often installed in a horizontal place. In the foregoing developing system, since the developer is discharged by overflow, the height position of the top surface of the developer with respect to the discharge port of the developing unit varies depending on the degree of inclination of the machine, and this largely affects the discharge of the developer.

For example, the developer is discharged satisfactorily in a horizontal state, but if the machine is inclined when it is installed, the developing unit is inclined and the height position of the top surface of the developer with respect to the discharge port is lowered. Thus, the developer will not be discharged. As the height position of the top surface of the developer with respect to the discharge port is lowered, the developer will not be discharged unless its volume increases unnecessarily. Therefore, the quantity of the incoming developer into the developing unit increases largely. As a result, the developer may spill, or excessive supply to the developing roller or change in the proportion of toner and carrier occurs, causing uneven density. Thus, a problem arises that high image quality cannot be maintained.

SUMMARY OF THE INVENTION

It is an object of this invention to provide a developing unit and a developer stirring and transporting method that enable smooth discharge of a developer in a developing unit without being affected by the inclination of the developing unit.

To solve the foregoing problem, a developing unit according to an aspect of this invention includes: a developing roller; a housing unit configured to house a developer and having in its sidewall a discharge port which discharges overflowing developer; a stirring and transporting member configured to stir and transport the developer along a passage formed in the housing; and a deposit structure unit provided in the passage and configured to raise a height position of a bottom part of the passage corresponding at least to the discharge port to a position higher than the other areas of the passage, and thereby deposit the developer near the discharge port.

A developing unit according to another aspect of this invention includes: developer supply means for supplying a developer to image carrier means; developer housing means for housing the developer supplied by the developer supply means and having in its sidewall a discharge port which discharges overflowing developer; stirring and transporting means for stirring and transporting the developer along a passage formed in the developer housing means; and deposit means for raising a height position of a bottom surface of the passage corresponding at least to the discharge port to a position higher than the other areas of the passage, and depositing the developer near the discharge port.

Moreover, a developer stirring and transporting method according to still another aspect of this invention includes, when stirring and transporting a developer in a container housing the developer, regulating a part of the developer flowing through a transport passage at a bottom part of a transport passage, thereby depositing the developer at the position of a discharge port, and discharging overflowing developer from the discharge port.

With the above configuration, even if the developing unit is inclined when it is installed, the height position of the top surface of the developer near the discharge port is less likely to change with respect to the inclination of the developing unit. Therefore, lowering of the height position of the top surface of the developer is restrained and large increase of the developer does not occur.

Thus, the conventional problems due to the inclined installation of the developing unit, including spilling of the developer from the developing unit, excessive supply to the developing roller, change in the proportion of toner and carrier, uneven density, and inability to maintain high image quality, can be solved.

DESCRIPTION OF THE DRAWINGS

FIG. 4(*b*) is an explanatory view schematically showing a protuberant state of a developer in a case where a developing unit is installed so that the height position on the downstream side in a developer transporting direction where a discharge port is situated is lower than on the upstream side.

FIG. 5(*b*) is a view showing a state where the developing unit according to the embodiment of this invention and the conventional developing unit are installed horizontally.

FIG. 5(*c*) is a view showing a state where the developing unit of the embodiment of this invention and the conventional developing unit are installed so that the height position on the downstream side in a developer transporting direction where a discharge port is situated is lower.

FIG. 8(*b*) is a view showing a state of a developer top surface in a case where a stirring and transporting member having no spiral shape near the discharge port is used.

FIG. 8(*c*) is a view showing states of a developer top surface in a case where stirring and transporting members having the spiral shapes of FIG. 8(*a*), FIG. 8(*b*) and other two types of spiral shapes.

DESCRIPTION OF THE EMBODIMENTS

Hereinafter, embodiments of this invention will be described with reference to the drawings.

Embodiment 1

Figure 1:
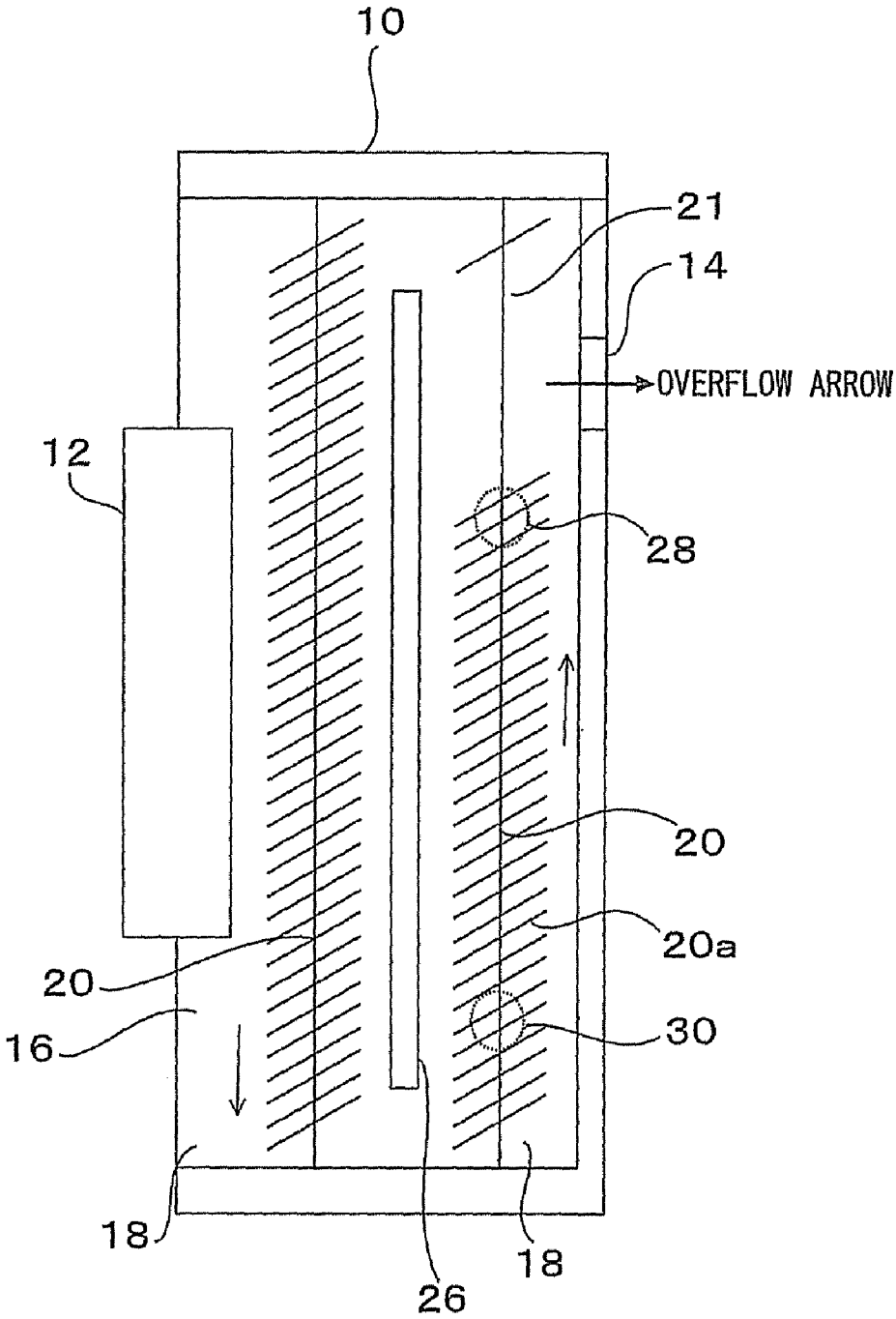
FIG. 1 is a plan view showing a section of a developing unit according to Embodiment 1, as sectioned along left and right directions at a vertically central part of a discharge port.
Figure 2:
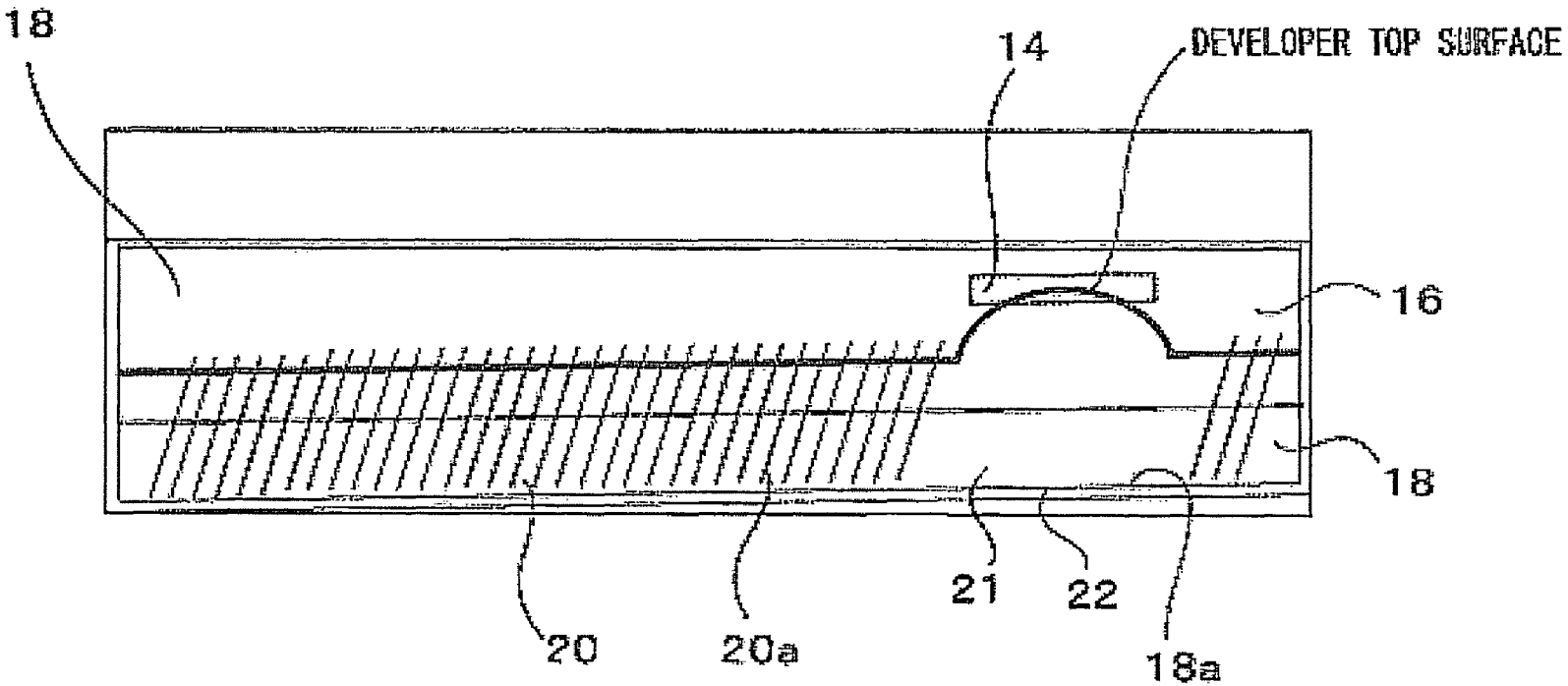
FIG. 2 is sectional view of the developing unit of FIG. 1 as viewed from the discharge port side (the sectional position is the center of the passage on the discharge port side).

FIG. 1 and FIG. 2 are structural views of a developing unit according to Embodiment 1. FIG. 1 is a plan view showing the developing unit according to Embodiment 1, as sectioned in right and left directions at a vertically central part of a discharge port. FIG. 2 is a sectional view of the developing unit as viewed from the discharge port side (the sectional position is the center of the passage on the discharge port side).

The developing unit 10 has a developing roller (developer supply means) 12, a housing unit (developer housing means) 16 configured to house a developer and having in its sidewall a discharge port 14 which discharges overflowing developer, a stirring and transporting member (stirring and transporting means) 20 configured to stir and transport the developer along a passage 18 formed in the housing unit 16, and a deposit structure unit (deposit means) 22 provided in the passage 18 and configured to raise the height position of a bottom surface 18*a* part of the passage 18 corresponding at least to the discharge port 14 to a position higher than the other areas of the passage 18, thereby regulate a part of the developer flowing through the passage 18 at the bottom part of the transport passage, and deposit the developer near the discharge port 14.

The discharge port 14 is provided at a position where it discharges excess developer out of the developing unit 10 by overflow so that the quantity of the developer housed in the developing unit 10 can be maintained at a predetermined quantity in accordance with the quantity of the developer supplied into the developing unit 10.

The deposit structure unit 22 is provided over the total length in the developer transporting direction of the bottom surface 18*a* of the passage 18 on the side where the discharge port 14 is provided, in the housing unit 16. The deposit structure unit 22 is configured to have the height position raised in the form of slope toward the downstream side in the developer transporting direction. The inclination angle of the slope is set at approximately 2 degrees or less.

Plural stirring and transporting members 20 are arranged parallel to each other in the housing unit 16. A partition 26 is provided between these plural stirring and transporting members 20. The passage 18 is formed by the inner wall of the housing unit 16 and the lateral surface of the partition 26. The stirring and transporting member 20 arranged in the passage 18 on the side where the discharge port 14 is provided is inclined in the direction of height, corresponding to the inclination of the deposit structure unit 22.

Each stirring and transporting member 20 is provided with a spiral 20*a*, and this spiral 20*a* rotates to stir and transport the developer. The developer circulates counterclockwise in the housing unit 16, as viewed from top. The developer is supplied to the developing roller 12.

The spiral 20*a* is not provided in a part near the discharge port 14 of the stirring and transporting member 20 on the discharge port 14 side. In this part where the spiral 20*a* is not provided, the power to stir and transport the developer is not generated. Therefore, the developer stays in this part and protuberates. This part where the spiral 20*a* is not provided constitutes a protuberant structure 21.

Also, a toner density sensor 28 for controlling the density of toner is arranged in the developing unit 10. The toner density sensor 28 is situated at a position indicated by a broken-line circle in FIG. 1 on the bottom surface of the housing unit 16.

Figure 10:
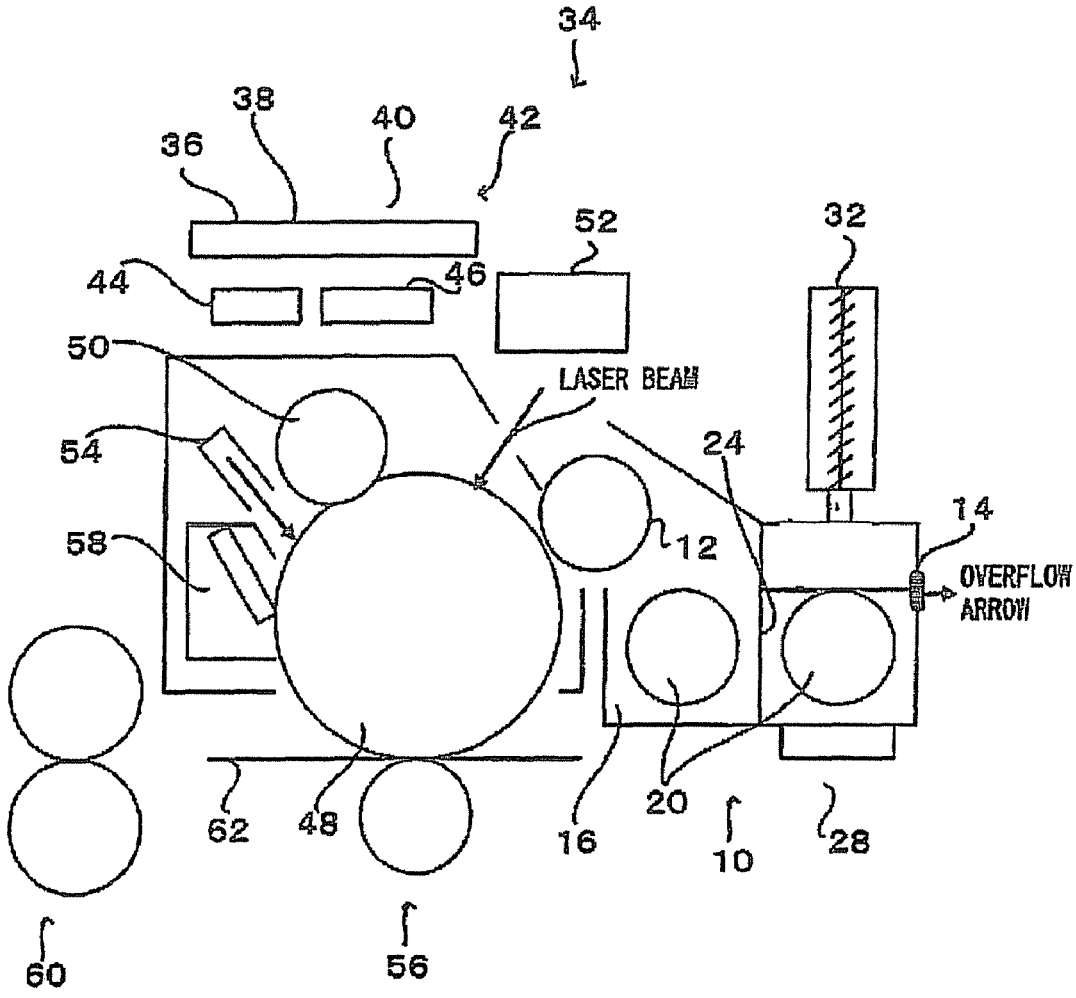
FIG. 10 is a structural view showing a copy machine, which is an image forming apparatus equipped with the developing unit according to the embodiment of this invention.

Moreover, in the developing unit 10, a supply port 30 for supplying the developer from a hopper 32 shown in FIG. 10 is arranged at a position indicated by a broken-line circle in FIG. 1 in the top part of the housing unit 16.

Next, the operation of Embodiment 1 will be described.

The developer supplied into the housing unit 16 via the supply port 30 from the hopper 32 is stirred and transported counterclockwise through the passage 18 by the stirring and transporting members 20. In the part where the developer is stirred and transported by the spirals 20*a* of the stirring and transporting members 20, the top surface of the developer indicated by the bold line in FIG. 2 is at a position lower than the discharge port 14. Near the discharge port 14 where the spiral 20*a* is not provided, the developer is not transported by the spiral 20 and therefore stays there. The developer is caused to protuberate by the deposit structure unit 22 on the bottom surface 18*a* of the passage 18 and the developer is satisfactorily discharged from the discharge port 14.

Next, using a conventional developing unit 32 shown in FIG. 3, the protuberant state of the developer with respect to the inclination of the developing unit 32 will be described.

Figure 3:
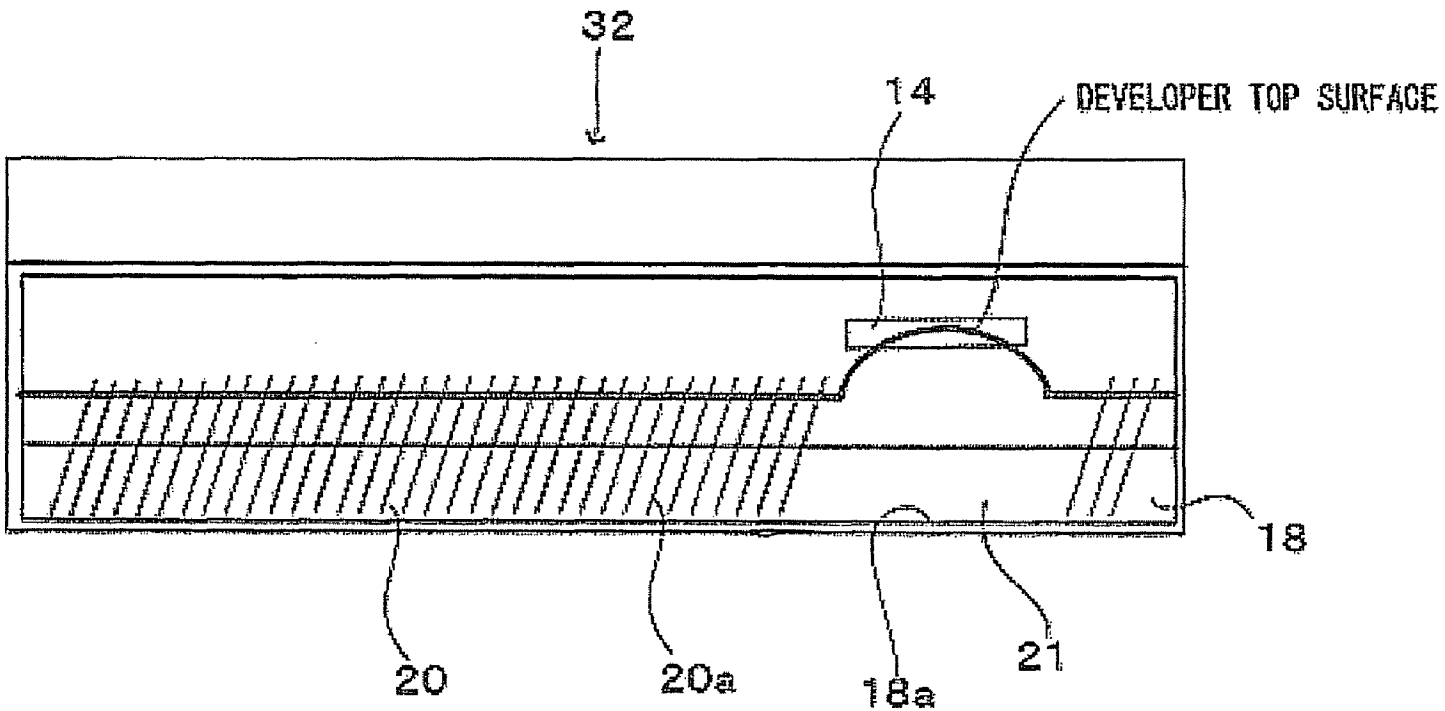
FIG.3 (Prior Art)
FIG. 3 shows an appearance of a conventional developing unit as viewed from the discharge port side.

The developing unit 32 shown in FIG. 3 has a structure similar to that of Embodiment 1, except for the horizontal bottom surface 18*a* of the passage 18, and therefore will not be described further in detail.

Figure 4A:
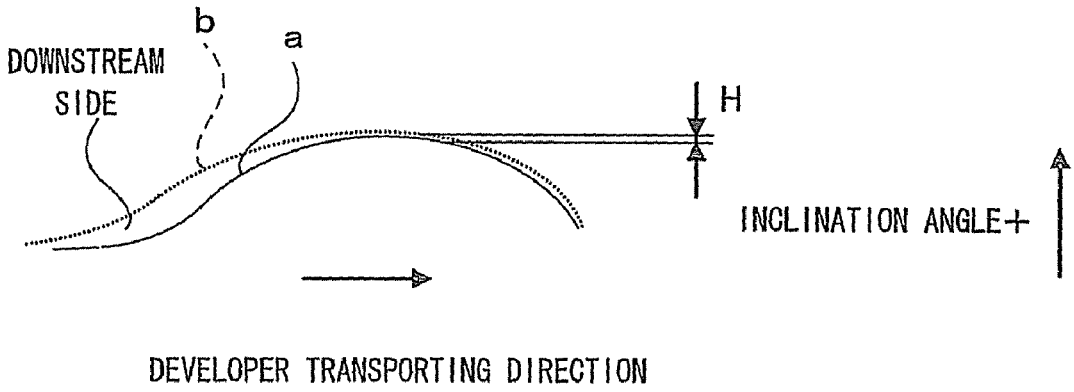
FIG. 4(*a*) is an explanatory view schematically showing a protuberant state of a developer in a case where a developing unit is installed so that the height position on the downstream side in a developer transporting direction where a discharge port is situated is higher than on the upstream side.
Figure 4B:
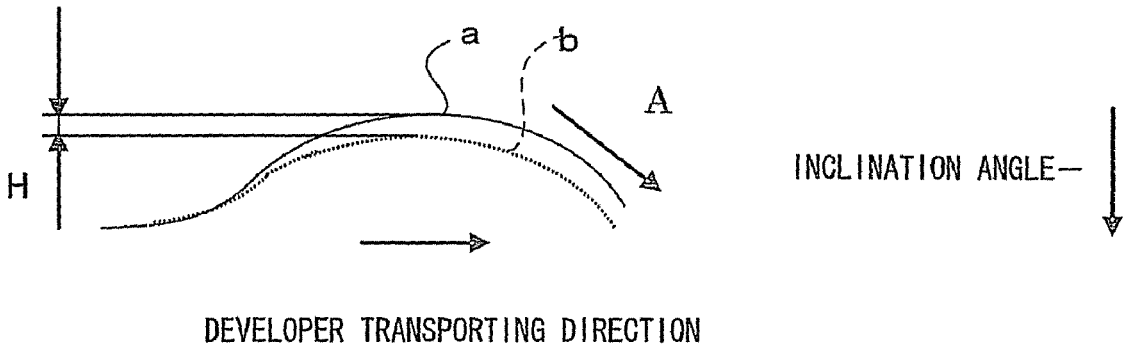

FIG. 4(*a*) is an explanatory view schematically showing the protuberant state of the developer in a case where the developing unit 32 is installed so that the height position on the downstream side in the developer transporting direction where the discharge port 14 is situated is higher than on the upstream side. FIG. 4(*b*) is an explanatory view schematically showing the protuberant state of the developer in a case where the developing unit 32 is installed so that the height position on the downstream side in the developer transporting direction where the discharge port 14 is situated is lower than on the upstream side.

First, the state of FIG. 4(*a*) will be described. The solid line shows a developer top surface a in the state where the developing unit 32 is installed horizontally. The broken line shows a developer top surface b in the case where the developing unit 32 is installed so that the height position on the downstream side in the developer transporting direction where the discharge port 14 is situated is higher than on the upstream side.

In this case, the developer top surface b is formed as the developer goes up an ascending slope, rather than further protuberating from the developer top surface a indicated by the solid line in the state where the developing unit 32 is installed horizontally. Therefore, as indicated by the broken line, the developer top surface b is formed by the developer staying upstream of the protuberant part and spreading at the bottom on the upstream side. The difference H (quantity of change) between the developer top surfaces a and b is little.

Next, the state of FIG. 4(*b*) will be described. The solid line shows a developer top surface a in the state where the developing unit 32 is installed horizontally. The broken line shows a developer top surface b in the case where the developing unit 32 is installed so that the height position on the downstream side in the developer transporting direction where the discharge port 14 is situated is lower than on the upstream side. In this case, the developer top surface b is formed as the developer goes down a descending slope. Therefore, the developer can easily flow on the downstream side of the protuberant part, as indicated by arrow A in FIG. 4(*b*), and the height of the protuberant part is lowered as shown by the broken line. The difference H (quantity of change) between the developer top surfaces a and b is large.

Next, using FIG. 5 and FIG. 6, the developing unit 10 according to Embodiment 1 is compared with the conventional developing unit 32 shown in FIG. 3, and the lowering state of the developer top surface due to the inclined installation of the developing units 10 and 32 will be described.

Figures 5A, 5B, 5C:
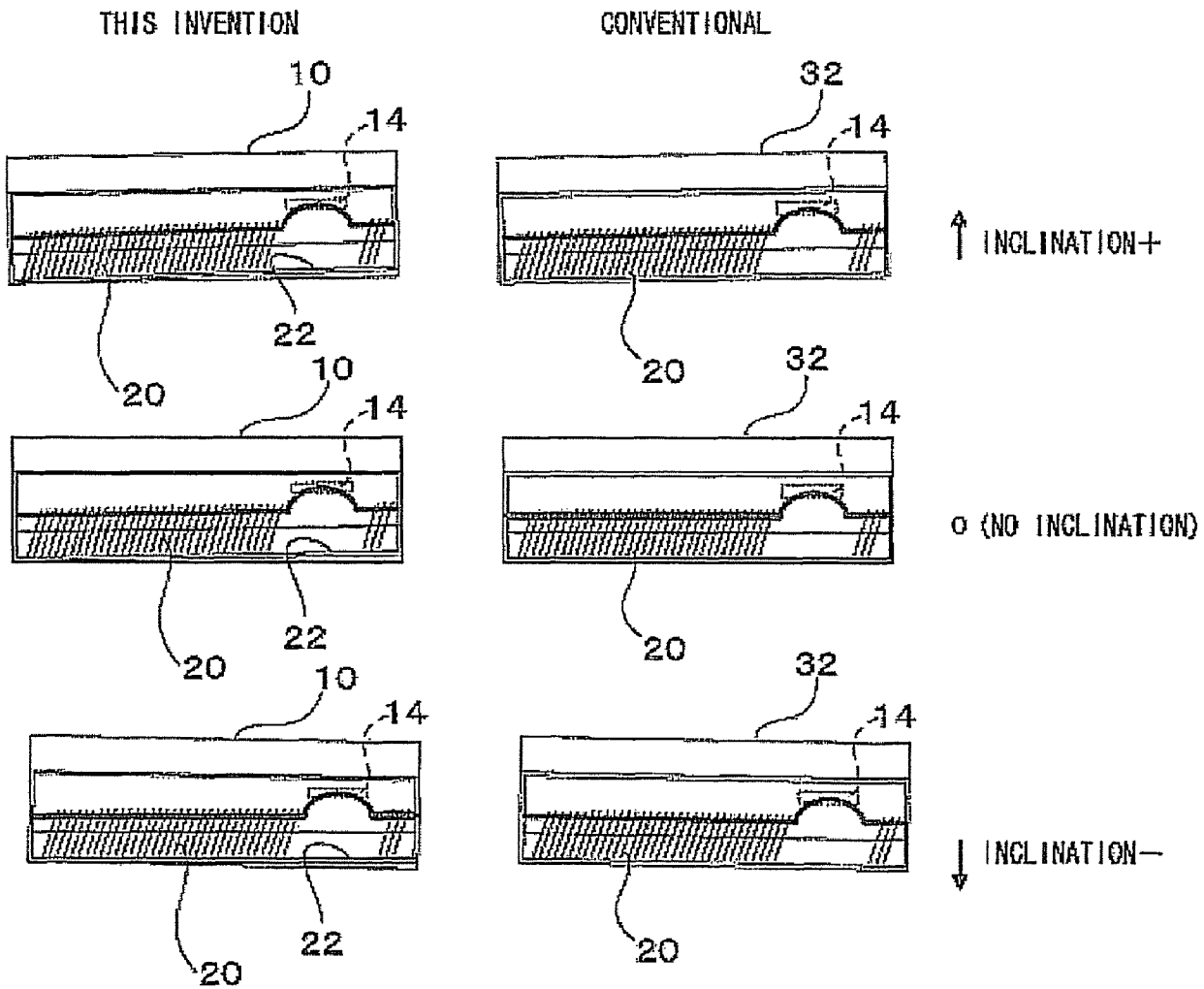
FIG. 5(*a*) is a view showing a state where the developing unit of the embodiment of this invention and the conventional developing unit are installed so that the height position on the downstream side in a developer transporting direction where a discharge port is situated is higher.

FIG. 5(*a*) shows a state where the developing units 10 and 32 are installed so that the height position on the downstream side in the developer transporting direction where the discharge port 14 is situated is higher. FIG. 5(*b*) shows a state where the developing units 10 and 32 are installed horizontally. FIG. 5(*c*) shows a state where the developing units 10 and 32 are installed so that the height position on the downstream side in the developer transporting direction where the discharge port 14 is situated is lower. FIG. 6 is a graph showing the relation between the inclination of the developing units 10 and 32 in each state of FIG. 5 and the quantity of change H of the developer top surface. The quantity of change H refers to the quantity of change H of the developer top surface shown in FIG. 4.

When measuring the developer top surface, since there is difficulty in mounting the developing units in an image forming apparatus, an experiment device is prepared that enables driving of the developing units 10 and 32 and inclination of the developing units 10 and 32, and the measurement is performed at the same driving speed as the driving speed of the image forming apparatus. The bold lines in FIG. 5(*a*) to FIG. 5(*c*) show the developer top surfaces.

Figure 6:
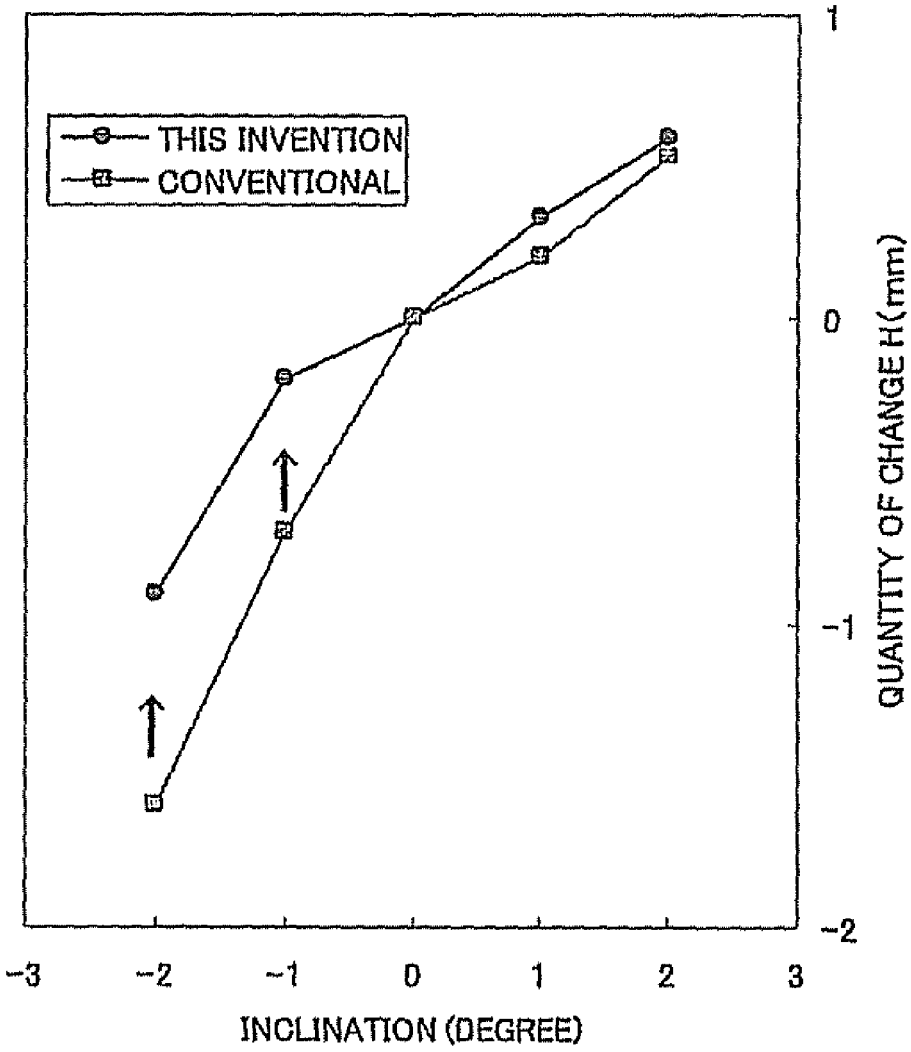
FIG. 6 is a graph showing the relation between the inclination in each state of FIG. 5 and the height of the top surface of the developer.

In the case where the inclination is zero, shown in FIG. 5(*b*), the height of the developer top surface is the same in the developing unit 10 and the developing unit 32 as shown in FIG. 6. That is, the value of the quantity of change H is the same in the two developing units.

In the case where the inclination is + (positive finite value), shown in FIG. 5(*a*), the value of the quantity of change H is smaller in the developing unit 32 than in the developing unit 10, but there is almost no difference between the two, as shown in FIG. 6.

However, in the case where the inclination is − (negative finite value), shown in FIG. 5(*c*), it can be seen that the value of the quantity of change H is much smaller (close to 0) in the developing unit 10 than in the developing unit 32 as shown in FIG. 6.

Also, as shown in FIG. 6, it can be seen that the value of the quantity of change H is smaller (close to 0) on the + side than on the − side in the developing unit 10 according to Embodiment 1. Thus, it can be seen that the developing unit 10 is a developing unit in which the lowering of the developer top surface is smaller for the + inclination.

From the above description, it can be understood that the developing unit 10 according to the embodiment of this invention is a developing unit having less variance such as raise and fall of the developer top surface with respect to the inclination of the developing unit 10.

Moreover, for confirmation, the developing unit 10 was mounted in an image forming apparatus and a short-life test for 10,000 sheets was carried out with the image forming apparatus inclined by +2 degrees and −2 degrees. As a result, in each state, there was no spilling of the developer and an image of high quality was successfully outputted to the end.

As described above, in the developing unit 10 according to the embodiment, since the variance of the developer top surface is small even if the developing unit is inclined, the lowering of the developer top surface can be reduced and the developer can be satisfactorily discharged from the discharge port. Therefore, there is no large increase of the developer in the developing unit 10, and even if the image forming apparatus installed in an inclined state, an image of high quality can be stably outputted.

Embodiment 2

Figure 7:
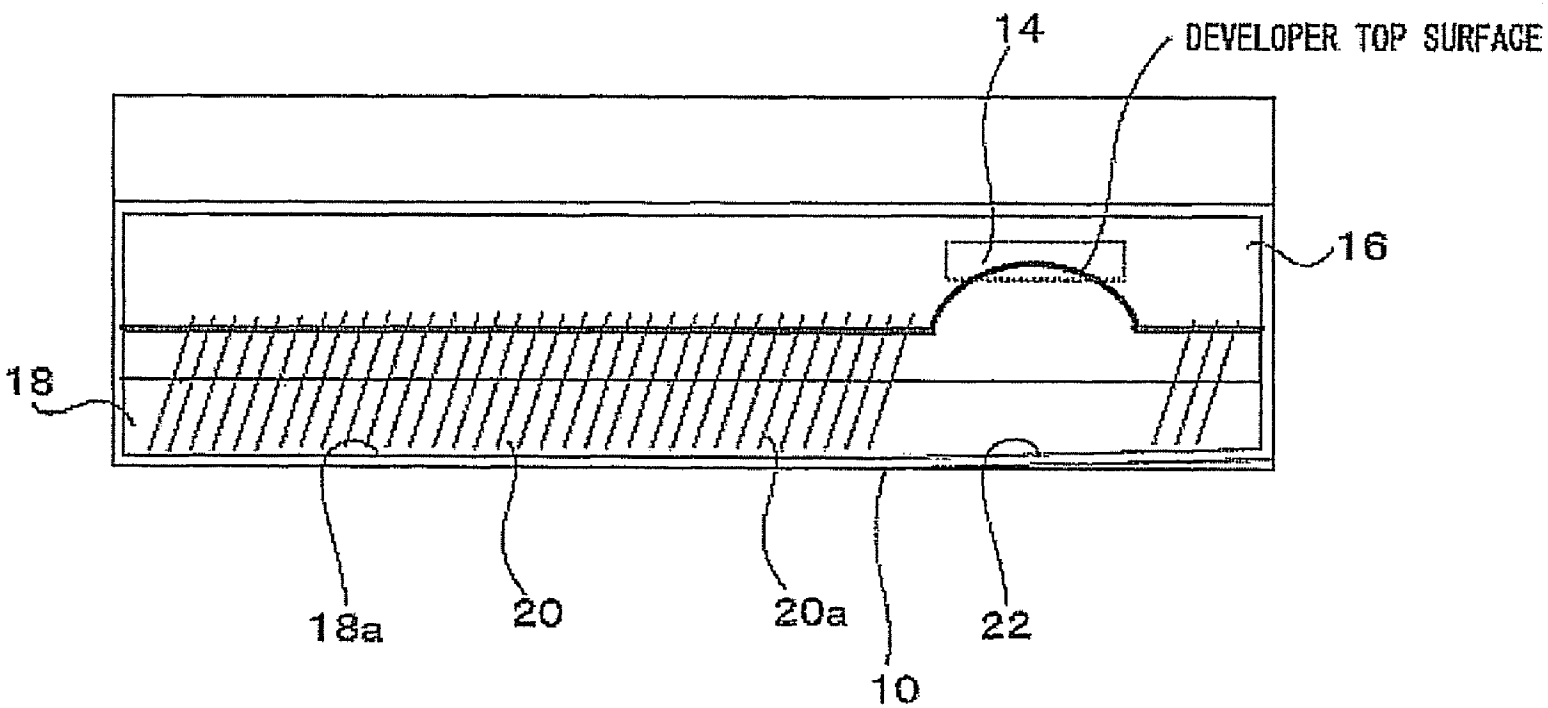
FIG. 7 is sectional view of the developing unit according to Embodiment 2 as viewed from the discharge port side (the sectional position is the center of the passage on the discharge port side equivalent to FIG. 1).

A developing unit according to Embodiment 2 will be described with reference to FIG. 7. FIG. 7 is a sectional view showing the developing unit according to Embodiment 2, as viewed from the discharge port side (the sectional position is the center of the passage on the discharge port 14 side). In Embodiment 2, the deposit structure unit 22 that becomes higher in the form of slope toward the downstream side in the developer transporting direction is formed in a part of the bottom surface 18*a* of the passage 18 of the developing unit 10. Specifically, the deposit structure unit 22 is formed from before an upstream-side end part of the discharge port 14. The other parts of the structure and the effects are similar to those of Embodiment 1 and therefore will not be described further in detail.

Figure 8A:
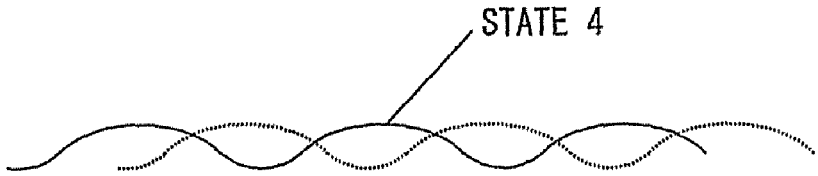
FIG. 8(*a*) is a view showing a state of a developer top surface in a case where a stirring and transporting member having no change in its spiral shape near the discharge port is used.
Figure 8B:
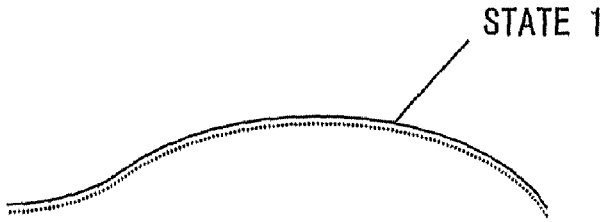
Figure 8C:
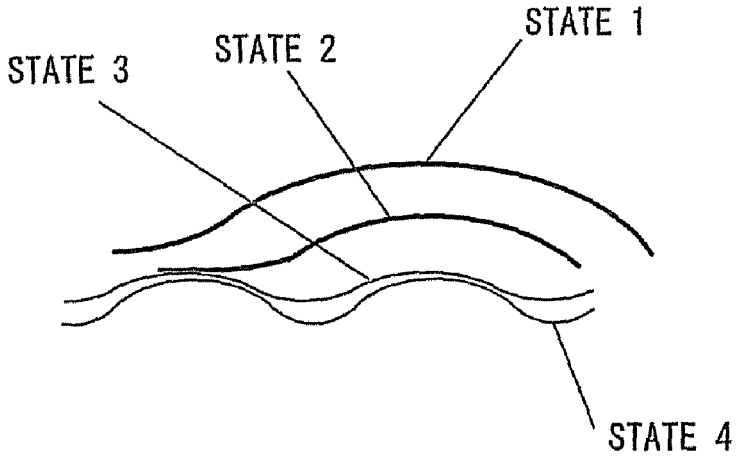

Next, the state of the developer top surface depending on the shape of the stirring and transporting member 20 will be described with reference to FIG. 8. In FIG. 8, to examine the state of the developer top surface near the discharge port 14, the wall of the developing unit 10 near the discharge port 14 is made of a transparent material to enable viewing inside, then the stirring and transporting member 20 is rotated at a predetermined number of rotations, a still image is captured from video images of the state of the developer in this case, and the profile of the developer top surface shown in the still image is traced.

FIG. 8(*a*) is a view showing the state of the developer top surface in a case where the stirring and transporting member 20 having no change in the shape of the spiral 20*a* near the discharge port 14, that is, having no protuberant structure 21, is used for comparison with the developing unit 10 using the stirring and transporting member 20 having the protuberant structure 21.

As shown in FIG. 8(*a*), even if the spiral 20*a* has entirely the same shape, the actual developer top surface is not linear. This is because, as the spiral 20 rotates, the developer top surface waves in accordance with the rotation of the spiral 20. As in state 4, the wavy developer top surface changes with the lapse of time, as indicated by the broken line.

In FIG. 2, FIG. 3, FIG. 5 and FIG. 7, the developer top surface is linear in the other parts than the part near the discharge port 14, in order to easily distinguish the part near the discharge port 14 from the other parts.

Next, FIG. 8(*b*) is a view showing the state of the developer top surface in a case where the stirring and transporting member 20 having the protuberant structure 21 where the spiral 20*a* is eliminated near the discharge port 14 is used.

In the part of the protuberant structure 21, since there is no spiral 20, the waving effect of the developer due to the rotation of the spiral 20 is hardly seen, and as in state 1, the developer largely protuberates. The largely protuberating developer top surface changes with the lapse of time, as indicated by the broken line.

Next, FIG. 8(*c*) is a view showing the state of the developer top surface in a case where the stirring and transporting member 20 having two kinds of protuberant structures 21 that are different from that of FIG. 8(*b*) is used, in order to further illustrate the difference in the state of the developer top surface between state 4 of FIG. 8(*a*) and state 1 of FIG. 8(*b*).

The width of the part having no spiral 20*a*, which is the protuberant structure 21 of the stirring and transporting member 20 in state 1 shown in FIG. 8(*b*), is assumed to be L. Then, in the protuberant structure 21 of the stirring and transporting member 20 in state 2, the pitch of the spiral 20*a* is ½, the height of the spiral 20*a* is ½ and its width is ½L, compared with the spiral 20*a* in the other parts.

In the protuberant structure 21 of the stirring and transporting member 20 in state 3, the width of the part having no spiral 20*a* is ½L.

As can be seen from FIG. 8(*c*), in state 2, the developer top surface is protuberant but not as much as in state 1. In state 3, the shape of the spiral 20*a* is changed, but the state of the developer top surface is close to state 4 having no change in the shape of the spiral 20*a*, and the developer top surface not protuberant, unlike state 1 and state 2.

In state 1 and state 2, the effect described with reference to FIG. 4 is achieved.

That is, with + inclination, where the downstream side in the developer transporting direction of the developing unit 10 rises, the developer looks like going up an ascending slope. Therefore, rather than further protuberating upward from the horizontal state shown by the solid line in FIG. 4, the developer top surface stays on the upstream side of the protuberance as shown by the broken line and protuberates like spreading at the foot of the upstream side.

Meanwhile, the developer top surfaces as in state 3 and state 4 are wavy and each wave is curved upward. Therefore, it might be seen as a protuberance. However, similar upward curves simply continue over the total length of the stirring and transporting member 20 and it is different from the state where a part of the developer top surface near the discharge port 14 is protuberant. Therefore, it is not the state where the developer stays on the upstream side of the protuberance as in state 1 and state 2.

The protuberance of the developer as referred to in the embodiments of this invention is the state like state 1 and state 2.

In each of the above embodiments, the deposit structure unit 22 has a configuration such that the height position rises in the form of slope toward the downstream side in the developer transporting direction of the passage 18. However, the deposit structure unit is not limited to this and it may have a step-like shape, convex shape or other shapes.

Embodiment 3

Figure 9:
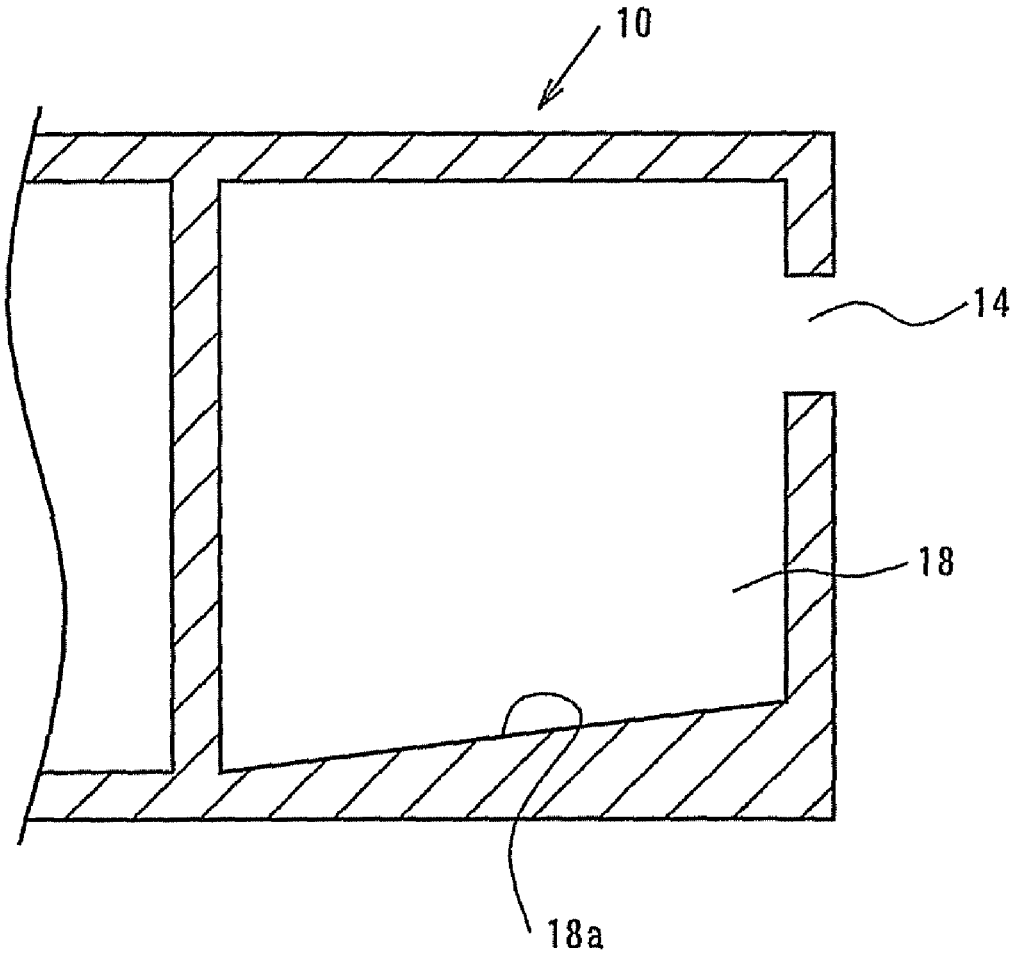
FIG. 9 is a sectional view showing a developing unit according to Embodiment 3, as sectioned along a direction orthogonal to the direction of a rotation axis of a stirring and transporting member at a discharge port.

FIG. 9 is a sectional view showing the developer 10, as sectioned in a direction orthogonal to the direction of the rotation axis of the stirring and transporting member 20 at the discharge port 14. As shown in FIG. 9, the height position of the bottom surface 18*a* of the passage 18 can be raised toward the discharge port 14, in the direction of width of the passage 18 (that is, direction orthogonal to the direction of the rotation axis of the stirring and transporting member 20), as Embodiment 3. In this case, the height position of the bottom surface 18*a* of the passage 18 can also be raised toward the downstream side in the developer transporting direction of the passage 18.

In this case, too, various shapes can be employed such as the sloped shape as shown in FIG. 9, a step-like shape or convex shape, as long as the operation and effects of the embodiments of this invention are achieved.

Next, a copy machine, which is an image forming apparatus equipped with the developing unit 10 according to the embodiments of this invention, will be described with reference to FIG. 10.

The copy machine 34 has a control panel 42 on which a copy button 36 for copying, a number-of-copy-sheets button 38 for inputting the number of copy sheets, a display 40 for displaying information of the copy machine 34, and the like are provided. In addition to this, a CPU 44 in charge of controlling copy, a memory 46 that saves necessary data for conducting control, a photoconductor (image carrier, image carrier means) 48, a charger (charging unit) 50 that charges the photoconductor 48, an exposure device (electrostatic latent image forming unit) 52 that forms an electrostatic latent image on the photoconductor 48, the developing unit 10 that supplies a developer to the electrostatic latent image by the developing roller 12 and develops the electrostatic latent image, an electricity remover 54 that removes electricity of the surface of the photoconductor 48, a transfer device (transfer unit) 56 that transfers a toner image from the photoconductor 48 to a paper 62, a cleaner device (cleaning unit) 58 that removes residual toner on the photoconductor 48 with a blade, and a fixing device (fixing unit) 60 that fixes the toner to the paper 62, are arranged.

The photoconductor 48 and at least one of the developing unit 10, the charger 50 and the cleaner device 58, and are integrally provided to form a process cartridge, and the process cartridge is provided in such a manner that it is attachable to and removable from the body of the copy machine 34.

Next, the operation at the time of recording will be described.

As the number of copy sheets is inputted by the number-of-copy-sheets button 38 on the control panel 42, and the copy button 36 is pressed, an image forming operation starts.

Under the control of the CPU 44, the surface of the photoconductor 48 is charged by the charger 50, and exposure corresponding to an image is performed by the exposure device 52, thus forming an electrostatic latent image on the photoconductor 48. The latent image on the photoconductor 48 is developed by the developer on the developing roller 12, and a developer image is formed on the photoconductor 48. The developer, which is constantly well stirred, is transported to the developing roller 12 by the stirring and transporting member 20.

The developer image formed on the photoconductor 48 is electrostatically transferred to the transported paper 62 by the transfer device 56 and is then fixed to the paper 62 by thermal press in the fixing device 60. Thus, a predetermined image is formed.

On the photoconductor 48 after the image is transferred to the paper 62, the residual toner is removed by the cleaner device 58 and light is cast from the electricity remover 54, thus removing electricity.

The above operation is repeated for the inputted number of copy sheets, and the copying ends.

The toner corresponding to the consumption by the development is supplied into the developing unit 10 from the hopper 32. Therefore, a small amount of carrier is supplied together with the toner. However, the amount of increased developer is discharged from the discharge port 14 by overflow and is accumulated in a waste developer container, not shown. As the degraded developer is thus replaced by the new developer, the development performance can be maintained and deterioration of the image quality can be restrained.

In this embodiment, the toner density in the developing unit 10 is detected by the toner density sensor 28, which performs magnetic detection. The quantity of toner to be supplied is decided in accordance with the output from the toner density sensor 28, thus controlling the quantity of developer to be supplied.

Each of the above operations is repeated to perform copying.

In the above embodiments, a part of or the entirety of the bottom surface 18*a* of the passage 18 on the side where the discharge port 14 is situated is inclined. However, the bottom surface 18*a* of the passage 18 on the side where the developing roller 12 is situated may be formed horizontally in order to prevent uneven attachment of the developer to the developing roller 12.

While this invention has been described in detail with reference to the specific embodiments, it is obvious to those skilled in the art that various changes and modifications can be made without departing from the spirit and scope of the invention.

As described above in detail, according to this invention, a developing unit and a developer stirring and transporting method can be provided that enable smooth discharge of a developer in the developing unit without being affects by the inclination of the developing unit.

What is claimed is:

1. A developing unit comprising:

a developing roller;

a first housing unit configured to house a developer to be supplied to the developing roller;

a first stirring and transporting member configured to stir and transport the developer along a first passage formed in the first housing unit;

a second housing unit configured to house a developer and to have in its sidewall a discharge port which discharges outside overflowing developer and to form a second passage which has a bottom surface raised in the form of a slope from a part corresponding to an adjacent part on an upstream side of an upstream side end part of the discharge port to a downstream side in a developer transporting direction; and a second stirring and transporting member configured to stir and transport the developer along the second passage and to have a first part which stirs and transports the developer and a second part which does not stir and transport the developer.

2. The developing unit according to claim 1, wherein a rotational direction of the first stirring and transporting member is opposite to a rotational direction of the second stirring and transporting member.

3. The developing unit according to claim 1, wherein the second passage has a bottom surface raised in the form of a slope from an upstream end of the discharge port towards a downstream side in a developer transporting direction.

4. The developing unit according to claim 1, wherein the second stirring and transporting member configured to not have a part which stirs and transports the developer in a vicinity of the discharge port in a developer transporting direction.

5. The developing unit according to claim 1, wherein the first housing and the second housing unit are partitioned with a partition part.

6. The developing unit according to claim 5, wherein the second passage is formed by an inner wall of the second housing unit and a lateral surface of the partition part.

7. The developing unit according to claim 1, wherein the second stirring and transporting member configured to have a spiral paddle and a rotational axis.

8. The developing unit according to claim 1, wherein the bottom surface has an inclination angle of approximately 2 degrees or less.

9. A developing unit comprising:

a developing roller;

a first housing unit configured to house a developer to be supplied to the developing roller;

a first stirring and transporting member configured to have a spiral paddle which stirs and transports the developer along a first passage formed in the first housing unit;

a second housing unit configured to house a developer and to have in its sidewall a discharge port which discharges outside overflowing developer and to form a second passage which has a bottom surface raised in the form of a slope from a part corresponding to an adjacent part on an upstream side of an upstream side end part of the discharge port to a downstream side in a developer transporting direction; and a second stirring and transporting member configured to stir and transport the developer along the second passage and to have a spiral part which stirs and transports the developer and a non-spiral part which does not stir and transport the developer.

10. The developing unit according to claim 9, wherein a rotational direction of the first stirring and transporting member is opposite to a rotational direction of the second stirring and transporting member.

11. The developing unit according to claim 9, wherein the second passage has a bottom surface raised in the form of a slope from an upstream end of the discharge port towards a downstream side in a developer transporting direction.

12. The developing unit according to claim 9, wherein the second stirring and transporting member configured to not have a part which stirs and transports the developer in a vicinity of the discharge port in a developer transporting direction.

13. The developing unit according to claim 9, wherein the first housing and the second housing unit are partitioned with a partition part.

14. The developing unit according to claim 13, wherein the second passage is formed by an inner wall of the second housing unit and a lateral surface of the partition part.

15. The developing unit according to claim 9, wherein the second stirring and transporting member configured to have a spiral paddle and a rotational axis.

16. The developing unit according to claim 9, wherein the bottom surface has an inclination angle of approximately 2 degrees or less.

* * * * *